US007000252B1

(12) United States Patent
Tobin

(10) Patent No.: US 7,000,252 B1
(45) Date of Patent: Feb. 21, 2006

(54) PROTECTIVE MASK

(75) Inventor: Christina Tobin, Colts Neck, NJ (US)

(73) Assignee: All Shore All-Star Cheerleading and Gymnastics, Inc., Lakewood, NJ (US)

( * ) Notice: Subject to any disclaimer, the term of this patent is extended or adjusted under 35 U.S.C. 154(b) by 66 days.

(21) Appl. No.: 10/894,280

(22) Filed: Jul. 19, 2004

(51) Int. Cl.
*A41D 13/00* (2006.01)

(52) U.S. Cl. ..... 2/9

(58) Field of Classification Search ..... 2/410, 2/424, 425, 9, 202, 171, 15
See application file for complete search history.

(56) References Cited

U.S. PATENT DOCUMENTS 127,331 A * 5/1872 Flora ..... 128/203.29
2,535,434 A * 12/1950 Marietta ..... 2/9
3,373,443 A * 3/1968 Marietta ..... 2/9
4,095,290 A * 6/1978 O'Brien ..... 2/9
5,206,955 A * 5/1993 Milligan ..... 2/9
5,845,340 A * 12/1998 Frislie ..... 2/202
5,940,886 A * 8/1999 McCarthy Smith ..... 2/206
6,012,164 A * 1/2000 Deal, III ..... 2/9

OTHER PUBLICATIONS

Three photographs of a prior mask sold at Consignment Sports, Howell, NJ.

* cited by examiner

*Primary Examiner*—Tejash Patel
(74) *Attorney, Agent, or Firm*—Michael R. Philips

(57) ABSTRACT

A protective face mask with a facial covering sheet is formed of an impact-resistant transparent sheet to match the contour of a face. The mask has mirror image eye openings that are open-sided, a mouth opening and an array of ventilation openings adjacent to the bottom of the nose of the wearer. A forehead pad and a pair of cheek pads are adhered to the inner surface of the mask to absorb impact. A set of elastic straps are provided to securely hold the mask onto the head of the wearer.

6 Claims, 2 Drawing Sheets

PROTECTIVE MASK

FIELD OF THE INVENTION

The present invention relates to the field of face masks, particularly protective face masks for use in sports.

BACKGROUND OF THE INVENTION

Physical action sports typically involve a risk of injury. When a cheerleader participates in a physical sport, the player assumes at least a portion of that risk. In some sports, such as football and hockey, a player may be injured by colliding with another player. In baseball, being hit by a ball or bat can cause serious injury. In these and other such sports, protective equipment has been developed and used to protect the players. Types of known protective sports equipment are various body pads, helmets and protective face masks. The known protective face masks have been developed to accommodate the particular needs of the sport in which they are used; for example, metal grid baseball catchers' masks or hockey goalie masks are suited to their respective sports.

Traditionally, cheerleading has been viewed as an auxiliary activity to encourage the team players of other sports to win. Cheers, the activity performed by cheerleaders, have become more elaborate and athletic in recent years, as evidenced by the spectacular halftime displays at football games. Along with the increase in the creativity and complexity of the cheers performed, cheerleading squads have been participating in competitions that have contributed to raising cheerleading to an exciting and challenging sport in its own right. These competitions are highly physical in nature, including gymnastic feats of strength, balance and skill. As an inherent result of the growth of cheerleading from a sideline activity to a competitive sport, the cheerleading participants are becoming more subject to injury from falling, collisions and impacting body parts.

While injury may occur to limbs and the body trunk in cheerleading as well as in other sports, damage to the face is of special concern because of the potential loss of sight or permanent disfigurement. In fact, due to the need for some cheerleading participants to support other cheerleading participants in acrobatic formations, body protection is impractical, but facial protection is important. Thus a need exists for a protective face mask that is usable in the sport of cheerleading. In addition to providing protection for all parts of the face of the cheerleader, such a mask should not interfere with vision, breathing or general agility.

SUMMARY OF THE INVENTION

The protective mask described herein comprises an impact-resistant sheet that is formed with eye and mouth openings and an additional array of ventilation openings adjacent to the lower portion of the nose of a wearer. The mask is preferably formed of a transparent plastic sheet. The mask is contoured to the form of a face. A series of resilient pads are mounted on the inner surface of the mask adjacent to the forehead and the cheek areas thereof. A set of elastic straps are connected to edge portions of the mask to hold the mask securely to the head of the wearer.

BRIEF DESCRIPTION OF THE DRAWINGS

The present invention is best understood in conjunction with the accompanying drawing figures in which like elements are identified by similar reference numerals and wherein.

DETAILED DESCRIPTION OF THE PREFERRED EMBODIMENT

Figure 1:
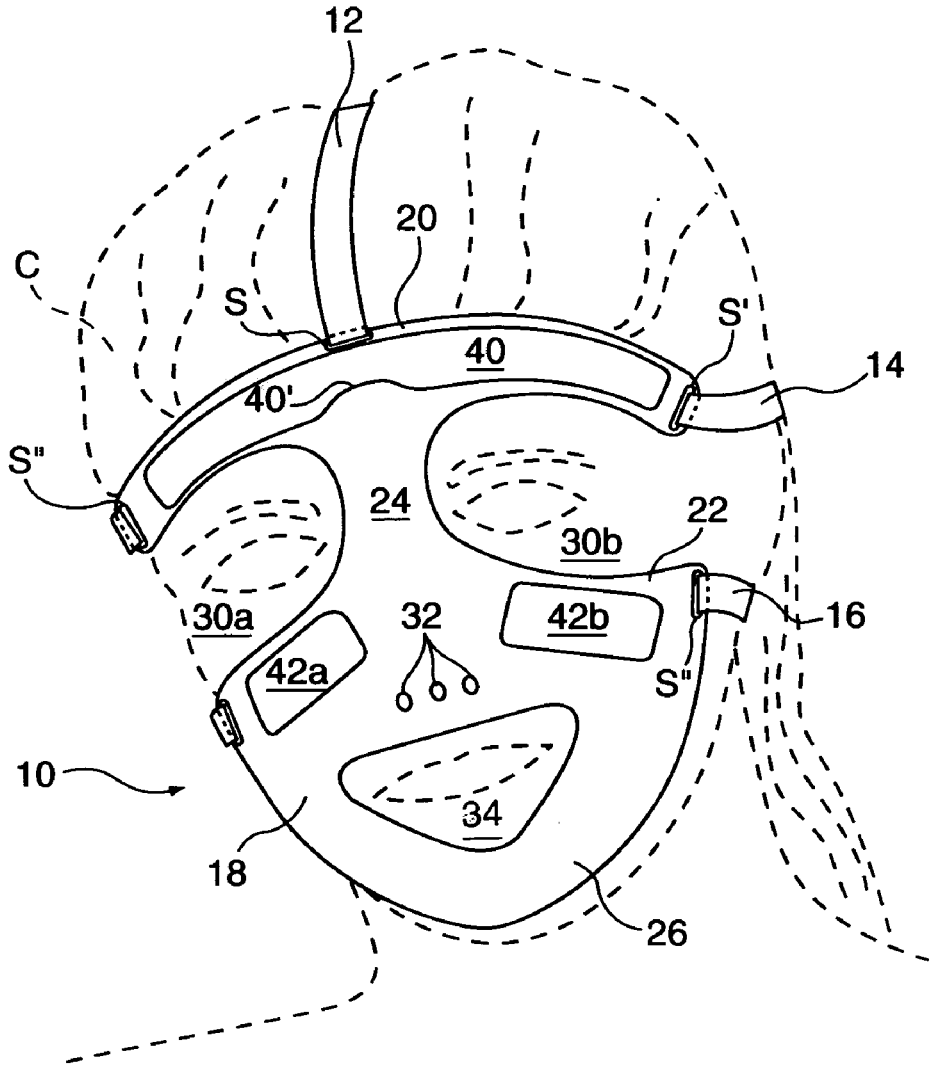
FIG. 1 is a perspective view of the protective mask of the present invention as it is worn by a typical cheerleader, the cheerleader's head being illustrated in dashed lines.

While the primary incentive for the development of the protective mask described herein involves cheerleading, it should be recognized that other sports applications of this mask are contemplated and deemed to be within the scope and spirit of the invention. Referring now to the drawing figures, FIG. 1 illustrates the protective mask 10 of the present invention being worn by a cheerleader C, illustrated in dashed lines. A facial covering sheet 18 of mask 10 is contoured to substantially match the shape of a human face and to be worn proximate thereto. Mask 10 is mounted onto the head of cheerleader C with a series of straps 12, 14 and 16, each of which is attached to respective edge portions of facial covering sheet 18. Strap 12 is attached to mask 10 by being passed through a slot S located centrally and adjacent to the upper edge of mask 10. Straps 14 and 16 are attached to mask 10 by being passed through slots S' and S", respectively, at opposed side edges of mask 10, with strap 14 attached approximately at the eye level, and strap 16 attached at the cheek level of the head of cheerleader C. Strap 12 is anchored to the rear center of each of straps 14 and 16 at respective areas A and B (see FIG. 3). In the preferred embodiment, straps 12, 14 and 16 are formed of elastic material, as is well known. Preferably, straps 12, 14 and 16 are made of woven elastic strands covered in fiber to avoid grabbing the hair of cheerleader C. Straps 12, 14 and 16 are also fitted with means for adjusting their length, for example buckles or Velcro® pads, to enable the wearer to fit mask 10 comfortably and securely to his or her head.

Figure 3:
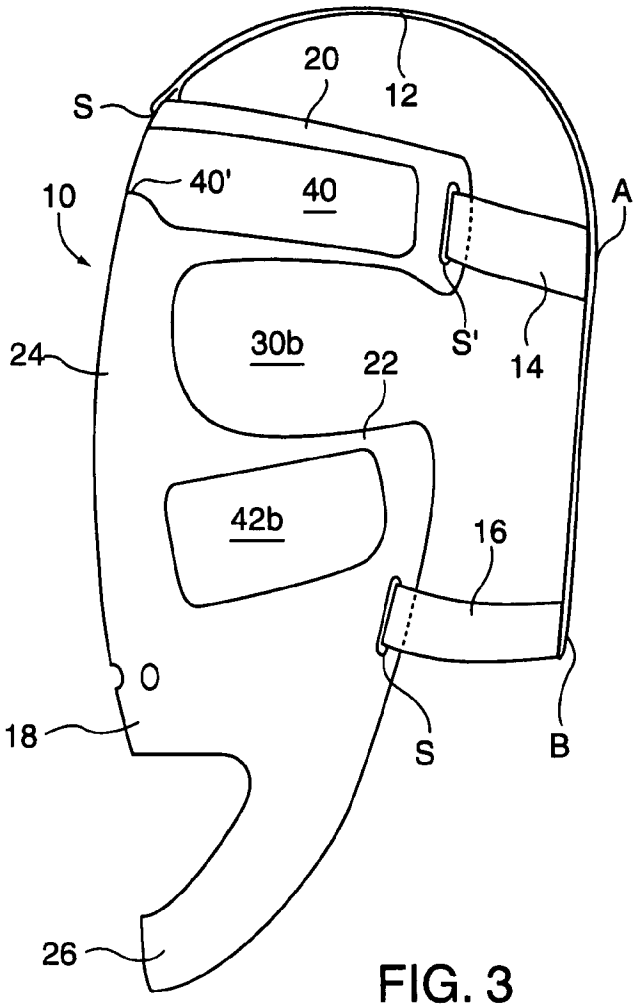
FIG. 3 is a side elevation view of the protective mask of the invention.
Figure 2:
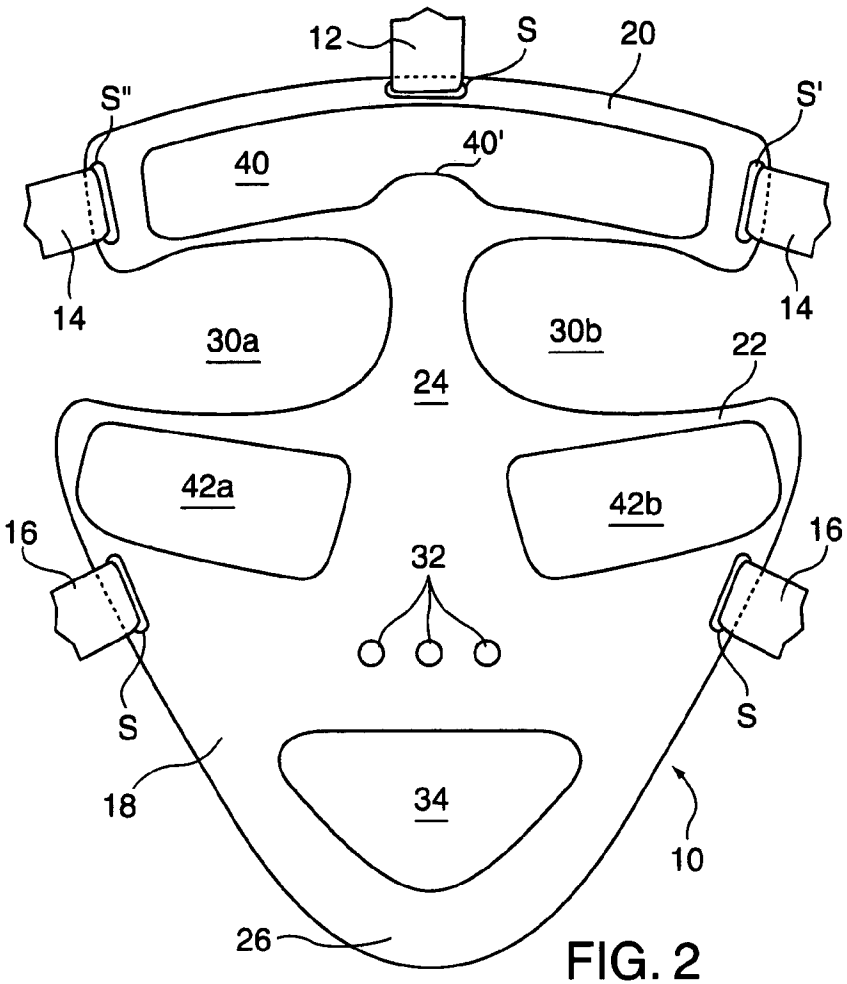
FIG. 2 is a front elevation view of the protective mask of the invention.

Referring now to FIGS. 2 and 3, mask 10 is shown in greater detail in front elevation and side elevation respectively. Facial covering sheet 18 is formed of a sheet of impact-resistant material with a series of openings therethrough, as well as a set of mounting straps 12, 14 and 16 and a plurality of resilient pads 40, 42*a* and 42*b*. As shown, mask 10 has a forehead guard 20, a cheek guard 22, a nose guard 24 and a chin guard 26, all of which are integral sections of facial covering sheet 18. Nose guard 24 is formed to protect the nose of the wearer from injury, and is narrow enough to permit full vision through eye openings 30*a* and 30*b*. Chin guard 26 blocks potential blows to the chin of the wearer, and mouth opening 34 is small enough to provide protection against tooth injury, while allowing normal speech. The impact resistant sheet forming facial covering sheet 18 of mask 10 is preferably a transparent plastic material, most preferably transparent polycarbonate resin. Use of transparent sheet material minimizes the interference with the vision of the wearer and allows the face to appear substantially normal, i.e. not distorted.

Facial covering sheet 18 is formed with eye opening 30*a* and eye opening 30*b* below forehead guard 20 and laterally adjacent to nose guard 24. Eye openings 30*a* and 30*b* are formed as mirror images of the letter "C", with their outer ends remaining permanently open. This form of eye opening, as opposed to a closed loop eye opening, permits the wearer a greater degree of peripheral vision, an important factor in many sports, particularly cheerleading. Nevertheless, eye openings 30*a* and 30*b* are sufficiently small to reduce the possibility of direct contact by arms or legs of other players with the face of cheerleader C. The "C" shaped, open-sided, eye openings allow clear peripheral vision by eliminating possible distortion or refraction that may otherwise be caused by viewing through the plastic sheet. In addition, although many plastic resins are impact resistant, few are highly scratch resistant. Therefore any plastic mask, polycarbonate included, will tend to become scratched through continued use, and an open eye opening 30*a*, 30*b* remains totally clear. Mouth opening 34 is formed slightly above chin guard 26 and configured to allow unimpeded communication and taking of fluids by cheerleader C without removal of mask 10. An array of ventilation openings 32 is formed above mouth opening 34 in a position substantially adjacent to the lower end of the wearer's nose for venting exhalations and avoiding the formation of condensation on the inner surface of mask 10. As will be understood, the particular shapes of the plural openings, and the number and array pattern of ventilation openings 32, are exemplary, and are not to be considered restrictive of the invention disclosed. For example, the protective mask of the invention could perform its function with a single ventilation opening 32.

A forehead pad 40 and two cheek pads 42*a* and 42*b* are assembled, for example by adhesive means, to appropriate positions on the inner surface of facial covering sheet 18. Forehead pad 40 is positioned to bear against the frontal skull bone. Cheek pads 42*a* and 42*b* are positioned to bear against the cheek bones. Pads 40, 42*a* and 42*b* are formed of a shock absorbing resilient material, for example, polyurethane foam or silicone gel, so as to absorb and distribute an impact to facial covering sheet 18 and provide protection from injury to the face of the wearer.

While the description above discloses preferred embodiments of the present invention, it is contemplated that numerous variations and modifications of the invention are possible and are considered to be within the scope of the claims that follow.

What is claimed is:

1. A protective mask to be worn by a player of a sport, comprising:

a. a contoured facial covering sheet having a mouth opening, a left eve opening being open at a left edge thereof and a right eve opening being open at a right edge thereof;

b. an array of ventilation openings formed in an area above the mouth opening so as to reside adjacent to a nose of the player;

c. a first resilient pad assembled to an inner surface of the facial covering sheet near an upper extremity thereof;

d. a pair of resilient pads assembled to left and right portions of the inner surface of the facial covering sheet below respective eye openings; and e. means for removably mounting the protective mask onto the head and over the face of the player.

2. The protective mask described in claim 1, wherein the means for removably mounting the protective mask comprises a plurality of resilient straps.

3. The protective mask described in claim 2, wherein opposed ends of a first resilient strap are attached to left and right edges of the facial covering sheet, a first end of a second resilient strap is attached to an upper central edge of the facial covering sheet and a second end of the second resilient strap is anchored to the first resilient strap.

4. The protective mask described in claim 3, further comprising a third resilient strap attached to left and right edges of the facial covering sheet so as to reside substantially parallel to the first resilient strap and having the second strap attached to a central portion thereof.

5. The protective mask described in claim 1, wherein the facial covering sheet is formed of a transparent, impact-resistant material.

6. The protective mask described in claim 5, wherein the transparent, impact resistant material is polycarbonate plastic resin.

* * * * *